United States Patent [19]

Iwai

[11] 4,159,551

[45] Jul. 3, 1979

[54] SEPARABLE BOAT

[75] Inventor: Kazuo Iwai, Kurobe, Japan

[73] Assignee: Yoshida Kogyo Kabushiki Kaisha, Tokyo, Japan

[21] Appl. No.: 824,814

[22] Filed: Aug. 15, 1977

[30] Foreign Application Priority Data

Aug. 17, 1976 [JP] Japan ..... 51/109788[U]

[51] Int. Cl.[2] ..... B63B 7/00

[52] U.S. Cl. ..... 9/2 A; 9/11 A; 9/347

[58] Field of Search ..... 9/311, 312, 313, 347, 9/328, 348, 1.3, 14, 11 R, 11 A, 2 R, 2 C, 2 F, 2 S, 2 A, 13; 114/68, 69, 267

[56] References Cited

U.S. PATENT DOCUMENTS

| | | | |
|---|---|---|---|
| 1,960,474 | 5/1934 | Browne | 9/347 |
| 2,529,961 | 11/1950 | Phillips | 9/347 |
| 2,584,884 | 2/1952 | Kirby | 9/11 A |
| 3,579,683 | 5/1971 | Robertson | 9/311 |

FOREIGN PATENT DOCUMENTS

| | | | |
|---|---|---|---|
| 1340742 | 12/1973 | United Kingdom | 114/267 |

*Primary Examiner*—Trygve M. Blix
*Assistant Examiner*—D. W. Keen
*Attorney, Agent, or Firm*—Bucknam and Archer

[57] ABSTRACT

A separable boat is disclosed which comprises a covering having a hollow peripheral casing and a flat deck, and a floatable member accommodated in the casing. A slide fastener is applied to fully open and close the casing. The floatable member comprises a plurality of floatable bags which are separably interconnected by slide fasteners, and can be conveniently carried separately from the covering.

5 Claims, 3 Drawing Figures

SEPARABLE BOAT

BACKGROUND OF THE INVENTION

1. Field of the Invention

This invention relates to boats made of rubber or other water-proof materials and has particular reference to such boat which is separable.

2. Prior Art

Many known inflatable rubber boats are substantially of a one-piece structure which requires deflation to a minimum volume when considering the convenience and ease of delivery to a destination. However, since it is very tedious and time-consuming to inflate the boats to an operative level upon arrival at the site, they would have to be in most cases inflated beforehand and carried on the roof of a motor vehicle or towed on a trailer, which poses a transportation problem.

SUMMARY OF THE INVENTION

With a view to eliminating the foregoing difficulties of the prior-art rubber boats, the present invention has for one of its object to provide a separable type of boat which is easy to assemble and disassemble, and is hence very conveniently portable.

Another object of the invention is to provide a separable type of boat made from rubber or other water-proof materials, which boat can be disassembled into individual members that can be used as a swimming aids, pillows or the like.

In accordance with the invention, there is provided a collapsible boat which comprises a covering and an annular floatable member both being made of rubber or other water-proof materials, and a slide fastener extending throughout the entire marginal periphery of said covering and being adapted in its closed disposition to provide a flat bottom and a hollow peripheral casing for receiving therein said tube member.

These objects and other features of the present invention will be more apparent from the following description taken in connection with the accompanying drawings with illustrate by way of example a preferred embodiment which the invention may assume in practice.

DETAILED DESCRIPTION OF THE PREFERRED EMBODIMENT

Figure 1:
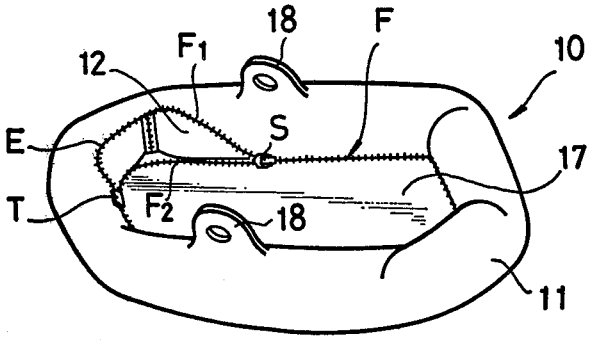
FIG. 1 is a perspective view of a separable boat provided in accordance with the invention.

Referring now to the drawings, and FIG. 1 in particular, there is shown a boat 10 provided in accordance with the invention, which is shown for illustrative purposes to be in the form of a rowboat. The boat 10, which is separable into members hereinafter described, comprises a covering sheet 11 and an annular floatable member 12, both being made of rubber or other water-proof materials.

Figure 3:
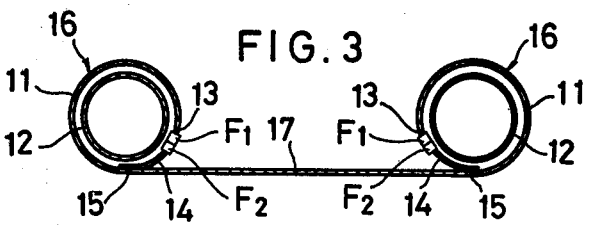
FIG. 3 is a sectional view of the boat shown in FIG. 1.

Designated at F is a slide fastener which comprises a pair of stringers $F_1$ and $F_2$ each having a row of interlocking fastener elements E, a slider S movable along the stringers $F_1$, $F_2$ to take the respective rows of elements E into and out of coupling engagement with each other in the well known manner and an end stop T adapted to restrict thereat the movement of the slider S. As better shown in FIG. 3, one of the pair of stringers $F_1$ is attached to a continuous marginal peripheral edge 13 of the covering sheet 11. The other stringer $F_2$ is attached to one longitudinal edge of an elongated strip 14 coextensive with the marginal edge 13 of the covering 11, while the other edge of the strip 14 is adhesively secured to an inner surface of the covering 11 as at 15. Coupling the two stringers $F_1$, $F_2$ together provides a hollow peripheral casing 16 for receiving the floatable member 12, and a flat bottom or deck 17 surrounded by the casing 16, the casing 16 functioning as a gunwale when the boat 10 is put afloat.

Figure 2:
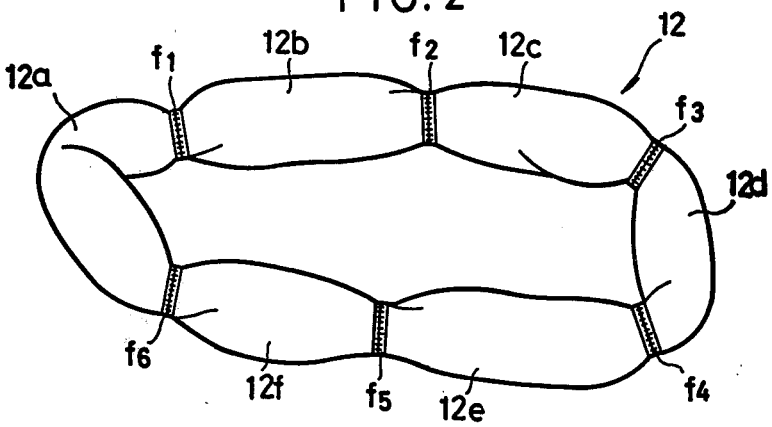
FIG. 2 is a perspective view of an annular floatable member which constitutes part of the boat of the invention.

The tube member 12 comprises a plurality of elongate floatable bags **12*a*–12*f* which are interconnected by slide fasteners $f_1$–$f_6$ to form a loop which per se is floatable in the form as shown in FIG. 2**.

Each of the bags **12*a*–12*f* is made of rubber, plastics or a similar water-proof elastic materials and is inflatable with air. Alternatingly, it may be made of a synthetic foam such as styrol which per se functions similar to and inflatable bag (12*a*–12*f***).

The end stop T of the slide fastener F is preferably of any known separable construction such that the covering 11 may be fully opened to take out the floatable member 12 and spread out into a flat sheet, whereupon it can be used for example as a beach carpet.

A similar separable end stop, though not shown, is applied to each of the bag fasteners $f_1$–$f_6$ whereby the floatable member 12 may be subdivided into individual bags **12*a*–12*f*** which can be utilized as pillows or the like.

Thus, the boat 10 comprising the two principal components which have been advanced is separable to a minimum portable size without need for inflating and deflating the same as has hitherto been experienced.

The assembling and disassembly of the boat 10 is greatly facilitation by simply opening and closing the slide fasteners. Designated at 18 is an oar lock.

From the foregoing, the artisan will appreciate that the invention provides a boat 10 which comprises a plurality of floatable units **12*a*, 12*b*, 12*c*, 12*d*, 12*e*, and 12*f* releasably connected endwise to one another to define an annular floatable number 12; a cover 11, having peripheral portions 13, 14 disposed to embrace said annular floatable member 12; and a slide fastener F connected to said portions 13, 14, together as shown in FIGS. 1 and 2, to secure the cover 11 to the annular floatable member 12 with said cover portions 13, 14 embracing the annular floatable member 12**.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A boat which comprises a plurality of floatable units disposed endwise in relation to one another about a closed path; a plurality of slide fasteners each releasably connecting together, at respective end portions, a pair of corresponding adjoining floatable units to define with said plurality of floatable units an annular floatable member; a cover having peripheral portions disposed to embrace said annular floatable member; a slide fastener extending along said closed path and operable to releasably connect said peripheral portions together to secure the cover to the annular floatable member with said peripheral portions of the cover embracing the annular floatable member, said peripheral portions of the cover, when connected together by said slide fastener along said closed path, defining a hollow casing for receiving therein said annular floatable member.

2. A boat according to claim 1 wherein each pair of adjoining floatable units are tapered toward and at respective end portions releasably connected together by one of said plurality of slide fasteners.

3. A boat according to claim 1 wherein said cover is made of sheet material and defines a flat bottom closure of the boat.

4. A boat according to claim 1 wherein at least one of said floatable units is an inflatable bag.

5. A boat according to claim 1 wherein said slide fastener along said closed path includes a separable end stop.

* * * * *